US008365567B2

(12) United States Patent
Ogawa et al.

(10) Patent No.: US 8,365,567 B2
(45) Date of Patent: Feb. 5, 2013

(54) ROLLING MILL AND ROLLING METHOD FOR FLAT PRODUCTS OF STEEL

(75) Inventors: Shigeru Ogawa, Tokyo (JP); Atsushi Ishii, Tokyo (JP); Daisuke Kasai, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 117 days.

(21) Appl. No.: 12/735,362

(22) PCT Filed: Feb. 24, 2009

(86) PCT No.: PCT/JP2009/053791

§ 371 (c)(1),
(2), (4) Date: Jul. 8, 2010

(87) PCT Pub. No.: WO2009/110395

PCT Pub. Date: Sep. 11, 2009

(65) Prior Publication Data

US 2010/0288007 A1 Nov. 18, 2010

(30) Foreign Application Priority Data

Mar. 4, 2008 (JP) ..... 2008-052930
Nov. 14, 2008 (JP) ..... 2008-291590

(51) Int. Cl.
*B21B 13/14* (2006.01)

(52) U.S. Cl. ..... 72/241.2; 72/241.4; 72/243.2; 72/243.4

(58) Field of Classification Search ..... 72/241.2, 72/241.4, 241.6, 241.8, 243.2, 243.4
See application file for complete search history.

(56) References Cited

U.S. PATENT DOCUMENTS 1,905,129 A * 4/1933 Biggert, Jr. et al. ..... 72/243.4
(Continued)

FOREIGN PATENT DOCUMENTS

JP 05-038504 2/1993
JP 05-050109 3/1993
(Continued)

OTHER PUBLICATIONS

International Search Report dated Jun. 9, 2009 issued in corresponding PCT Application No. PCT/JP2009/053791.

*Primary Examiner* — Bena Miller
(74) *Attorney, Agent, or Firm* — Kenyon & Kenyon LLP

(57) ABSTRACT

The object is to eliminate the difference in offset of work rolls at the upper and lower and left and right of the rolling mill occurring in the kiss roll state of the zero point adjustment work before rolling or during rolling and eliminate the problem of warping of the flat products or meander or camber due to the thrust force acting between the work rolls and backup rolls.

For this, there are provided a rolling mill for flat products having a pair of upper and lower work rolls driven by electric motors, a pair of upper and lower backup rolls contacting the work rolls and supporting the rolling reaction force applied to the work rolls, and devices for applying substantially horizontal direction external forces to the upper and lower work rolls, the rolling mill for flat products characterized in that a direction of horizontal direction external forces applied to the work rolls is the same direction as the horizontal direction force component of the rolling reaction force applied to the work rolls due to the rolling direction offset and in that the horizontal direction external forces applied to the work rolls are supported by rolling mill housing project blocks or work roll chock support members, and a rolling method for flat products using the same.

20 Claims, 7 Drawing Sheets

U.S. PATENT DOCUMENTS

| | | | | | |
|---|---|---|---|---|---|
| 1,972,158 | A | * | 9/1934 | Moreland | 72/242.2 |
| 2,118,284 | A | * | 5/1938 | Worthington | 72/243.2 |
| 3,533,263 | A | * | 10/1970 | Wochnilk et al. | 72/243.2 |
| 3,724,252 | A | * | 4/1973 | Baker et al. | 72/243.4 |
| 4,197,731 | A | * | 4/1980 | Verbickas et al. | 72/243.4 |
| 4,248,073 | A | * | 2/1981 | Verbickas et al. | 72/243.4 |
| 4,270,377 | A | * | 6/1981 | Verbickas et al. | 72/243.4 |
| 4,462,236 | A | * | 7/1984 | Turley et al. | 72/243.4 |
| 4,531,394 | A | * | 7/1985 | Turley et al. | 72/238 |
| 4,577,480 | A | * | 3/1986 | Kizaki et al. | 72/10.5 |
| 4,614,103 | A | * | 9/1986 | Takagi et al. | 72/243.2 |
| 4,631,948 | A | * | 12/1986 | Bald et al. | 72/243.4 |
| 4,724,698 | A | * | 2/1988 | Ginzburg | 72/243.4 |
| 4,850,211 | A | * | 7/1989 | Sekiguchi et al. | 72/10.3 |
| 5,007,273 | A | * | 4/1991 | Kummerhoff | 72/242.2 |
| 5,119,656 | A | * | 6/1992 | Kobayashi et al. | 72/13.4 |
| 5,165,266 | A | * | 11/1992 | Ginzburg | 72/14.5 |
| 5,406,817 | A | * | 4/1995 | Takakura et al. | 72/14.4 |
| 5,560,237 | A | * | 10/1996 | Yasuda et al. | 72/13.4 |
| 6,003,355 | A | * | 12/1999 | Yasuda et al. | 72/243.4 |
| 6,151,943 | A | * | 11/2000 | Nihei et al. | 72/241.2 |
| 6,446,477 | B2 | * | 9/2002 | Yasuda et al. | 72/243.4 |
| 7,104,101 | B1 | * | 9/2006 | Berger et al. | 72/243.4 |
| 2001/0020380 | A1 | | 9/2001 | Yasuda et al. | |
| 2006/0254335 | A1 | * | 11/2006 | Turley | 72/243.2 |

FOREIGN PATENT DOCUMENTS

| | | |
|---|---|---|
| JP | 05-185106 | 7/1993 |
| JP | 08-164408 | 6/1996 |
| JP | 10-277619 | 10/1998 |
| WO | WO 01/64360 | 9/2001 |

* cited by examiner

ROLLING MILL AND ROLLING METHOD FOR FLAT PRODUCTS OF STEEL

This application is a national stage application of International Application No. PCT/JP2009/053791, filed 24 Feb. 2009, which claims priority to Japanese Application Nos. 2008-052930, filed 4 Mar. 2008; and 2008-291590, filed 14 Nov. 2008, each of which is incorporated by reference in its entirety.

TECHNICAL FIELD

The present invention relates to a rolling mill for flat products having work rolls driven by electric motors and backup rolls supporting the rolling reaction force applied to the work rolls and a rolling method for flat products using the same.

BACKGROUND ART

In a rolling mill for flat products having work rolls driven by electric motors and backup rolls supporting the rolling reaction force applied to the work rolls, the method has been employed of shifting the work roll axial center positions and backup roll axial center positions to give a certain length of rolling direction offset and generating a horizontal direction (unless particularly stated to the contrary, the "horizontal direction" indicates the rolling direction) force component of the rolling reaction' force to push the work roll chocks against the inner surfaces of the rolling mill housing window and thereby roll flat products of stable shapes. Various proposals have been made in the past.

For example, Japanese Patent Publication (A) No. 05-038504 discloses a cross roll rolling milling of a structure pushing the work roll chocks in the horizontal direction.

However, the rolling mill of this Japanese Patent Publication (A) No. 05-038504 is of a structure pushing only the work roll chocks, so there was the problem that it was not possible to suppress fluctuation in the amount of work roll offset due to looseness of the work roll bearings present between the work roll chocks and the work rolls.

Japanese Patent Publication (A) No. 05-050109 discloses a rolling mill for flat products providing support rollers for supporting the work rolls in the horizontal direction at the entrance and exit sides of the rolling mill.

The work rolls of the rolling mill of this Japanese Patent Publication (A) No. 05-050109 assume small sized work rolls for rolling hard materials and ultrathin materials. They are not directly driven by electric motors, but are indirectly driven through the backup rolls. In the case of indirect drive, due to the transmission of the drive force, a large horizontal force acts on the work rolls from the backup rolls. Due to the interaction with the horizontal direction force of the rolling load, this becomes a cause of instability. In particular, in the case of small sized work rolls, the horizontal direction deflection of the work rolls becomes large whereby this instability is aggravated, so it was necessary that both smaller size of the work rolls and increase of the rigidity be achieved by the horizontal direction support rollers.

However, this rolling mill is designed for elimination of deflection and minimization of the size of the work rolls by greatly increasing the rigidity of the small sized work rolls, so the problems of zero point adjustment used as the standard in control of rolling and maintenance of the zero point adjustment state are not solved.

Japanese Patent Publication (A) No. 08-164408 discloses a rolling mill for flat products providing support rollers for support in the horizontal direction at one side of the work rolls.

However, the rolling mill of this Japanese Patent Publication (A) No. 08-164408, like the rolling mill of Japanese Patent Publication (A) No. 05-050109, is a rolling mill of an indirect drive type using small sized work rolls. In the same way as Japanese Patent Publication (A) No. 05-050109, due to the small sized rolls, the roll rigidity is small and deflection in the horizontal direction easily occurs. If a difference in deflection occurs between the upper and lower work rolls, the rolling becomes instable, so to increase the work roll rigidity in the horizontal direction and control the system so that no difference in deflection occurs between the upper and lower work rolls, horizontal direction support rollers are provided at the upper and lower work rolls.

The support rollers used in this rolling mill are structured to support the work rolls by giving forces in a direction opposite to the horizontal direction force component of the rolling reaction force generated due to offset of the work rolls, so were not able to stabilize the axial center positions of the work rolls. Further, in the same way as the work rolls of Japanese Patent Publication (A) No. 05-050109, the problems of zero point adjustment used as the standard in control of rolling and maintenance of the zero point adjustment state are not solved.

Japanese Patent Publication (A) No. 05-185106 discloses a rolling mill for flat products providing intermediate rolls for giving horizontal direction deflection at one side or both sides of the work rolls. This positively applies deflection to the work rolls so as to control the shape of the rolling material by the profiles of the work rolls (in particular the surface relief in the pass line direction of the rolled material). For this reason, the intermediate rolls are structured tapered. The work rolls are made to deflect along this, so a bending force is given to the bearings.

However, the axial ends of the work rolls used in the rolling mills of this Japanese Patent Publication (A) No. 05-185106 are structured to give the horizontal direction bending force for support in load control. There was the problem that the structures did not strictly control the work roll offset positions. Further, the problems of zero point adjustment and maintenance of the zero point adjustment state, that is, the inability to determine the reference points in rolling control, remained.

Japanese Patent Publication (A) No. 10-277619 discloses a rolling mill for flat products imparting a horizontal force to one of the upper and lower work rolls. The rolling mill of this Japanese Patent Publication (A) No. 10-277619 is a rolling mill in which the axial centers of the work rolls are offset from the axial centers of the backup rolls in the rolling exit side direction wherein when the rolled material leaves the rolling mill, the upper and lower work rolls contact if the roll gap is small and the difference in size of the upper and lower work rolls will cause the large sized roll to move in the rolling entrance direction, so to prevent this, the large sized side roll is given a horizontal force and the large sized work roll is pushed in the rolling exit side direction.

However, the horizontal force is given by the invention of Japanese Patent Publication (A) No. 10-277619 assuming application to only the large sized work roll when the rolled material leaves the rolling mill and the upper and lower work rolls contact, so for example when the upper work roll is large sized and the lower work roll is not given a device imparting a horizontal force, a difference will arise in the offset between the upper and lower work rolls and cause warping of the rolled material. In addition, there was the problem that a slight cross angle and thrust force are generated between the lower work roll and the lower backup roll and meandering and camber occur.

WO01/064360 discloses a rolling mill provided with a first pushing device giving a upper and lower direction balance force or bender force to the rolls through roll bearing boxes of the work rolls of the rolling mill and second pushing device giving a pushing force in a direction perpendicular to the rolling roll axis in the horizontal plane.

However, the external forces due to these pushing devices are given through the bearing boxes, so in the same way as Japanese Patent Publication (A) No. 05-038504, there was the problem that it was not possible to suppress fluctuation in the work roll offset due to looseness of the work roll bearings present between the work roll bearing boxes and the work rolls.

DISCLOSURE OF THE INVENTION

The present invention has as its object to solve the problems in the prior art explained above and provide a rolling mill for flat products and rolling method for flat products which strictly eliminates the difference in offsets of the work rolls at the upper and lower and left and right (work side WS/drive side DS) of the rolling mill occurring during rolling and in the kiss roll state of zero point adjustment work before rolling and eliminates the problems of warping of the flat products and meander and camber etc. due to thrust force occurring between the work rolls and backup rolls.

The inventors engaged in intensive studies regarding the above-mentioned problems and as a result discovered that the fluctuations in the offset of the upper and lower work rolls during rolling (deviation of work roll axial center and backup roll axial center in horizontal direction) are greatly related in the problems of the warping of the rolled material and meander and camber—problems leading to grave trouble and abnormal quality in flat product rolling operations.

For example, they discovered that the upper and lower difference of the work roll offset fluctuates by about 0.2 mm, that the warping and waviness of the rolled material greatly changes, and that the left and right difference of the work roll offset (difference of work side WS and drive side DS) fluctuates by about 0.2 mm, so the thrust coefficient between the work rolls and backup rolls is about 0.004, that is, a significant thrust force of about 4 tf is generated for 1000 tf rolling load.

The thrust force acting between the work rolls and backup rolls is governed by the structure and dimensions of the rolling mill as well, but manifests itself as substantially the same degree of left-right difference of the rolling load. For example, when performing the roll position zero point adjustment of the roll gap control devices at the drive side and work side by outputs of rolling load measurement use load detection devices, the thrust force between the work rolls and backup rolls becomes outside disturbance, accurate roll position zero point adjustment cannot be performed, and problems such as meander and camber are also caused. Therefore, in the present invention, it is necessary to consider looseness of the work roll bearings and deformation of the work roll necks as well and strictly eliminate upper and lower and left and right differences in work roll offset to realize stable rolling.

Further, even during'rolling, the left and right difference in the rolling load due to the thrust force induces left and right differences in the rolling rate and meander of the rolled material through the left and right difference in mill deformation. Furthermore, the left and right difference in the work roll offset itself becomes slight error in the angle of entry of the rolled material in the horizontal plane, so continuing rolling in this state leads directly to meander of the rolled material. Due to the above, the inventors believed that by stabilizing the positions of the work rolls, they would be able to prevent warping, meander, and camber.

The inventors completed the present invention based on this basic thinking for solving the problems.

As a result, the inventors provide a rolling mill for flat products and a rolling method for flat products which provide devices for applying substantially horizontal direction external forces to the work rolls in the same direction as the horizontal direction force component of the rolling reaction force applied to the work rolls due to rolling direction offset and thereby strictly eliminate the difference in offset of work rolls at the upper and lower and left and right (work side WS/drive side DS) of the rolling mill occurring during rolling or in the kiss roll state of the zero point adjustment work before rolling and eliminate the problem of warping of the flat products or meander or camber due to the thrust force acting between the work rolls and backup rolls.

The gist of the invention is as follows:

(1) A rolling mill for flat products having a pair of upper and lower work rolls driven by electric motors and a pair of upper and lower backup rolls contacting the work rolls and supporting rolling reaction force applied to the work rolls, axial centers of the work rolls and axial centers of backup rolls contacting them being offset in the horizontal direction, the rolling mill for flat products characterized in that the mill has devices applying substantially horizontal direction external forces to barrels or shafts of the work rolls at positions of at least one location each at the work side and drive side across a center of the rolling mill in the width direction, for a total of two or more locations, for the respective upper and lower work rolls, the direction of horizontal direction external forces applied to the work rolls is the same direction as the horizontal direction force component of the rolling reaction force applied to the work rolls due to rolling direction offset between the work roll axial center positions and backup roll axial center positions, and the horizontal direction external forces applied to the work rolls are supported through work roll chocks by project blocks of the rolling mill housing or work roll chock support members connected to backup roll chocks.

(2) A rolling mill for flat products as set forth in (1) characterized in that the mill further has devices applying substantially horizontal direction external forces to barrels or shafts of the backup rolls at positions of at least one location each at the work side and drive side across a center of the rolling mill in the width direction, for a total of two or more locations, for the respective upper and lower backup rolls and in that the direction of horizontal direction external forces applied to the backup rolls is the same direction as the horizontal direction force component of the rolling reaction force applied to the backup rolls due to rolling direction offset between the work roll axial center positions and backup roll axial center positions.

(3) A rolling mill for flat products as set forth in (1) or (2) characterized in that the devices applying substantially horizontal direction external forces to the work rolls are provided at positions applying force near ends of the work roll barrels.

(4) A rolling mill for flat products as set forth in (1) or (2) characterized in that the devices applying substantially horizontal direction external forces to the work rolls are provided at positions applying force to axial ends of the work rolls outside the work roll chocks.

(5) A rolling mill for flat products as set forth in (1) or (2) characterized in that the devices applying substantially horizontal direction external forces to the work rolls are provided at positions applying force near ends of the work roll barrels and at positions applying force to axial ends of the work rolls outside the work roll chocks.

(6) A rolling mill for flat products as set forth in (1) or (2) characterized in that the devices applying substantially horizontal direction external forces to the work rolls are provided at positions applying force near ends of the work roll barrels and center parts of the work roll barrels are provided with devices applying substantially horizontal direction external forces smaller than and in an opposite direction from the total value of the horizontal direction external forces applied near the axial ends of the work roll barrels.

(7) A rolling mill for flat products as set forth in (1) or (2) characterized in that the devices applying substantially horizontal direction external forces to the work rolls are provided at positions applying force to axial ends of the work rolls outside the work roll chocks and center parts of the work roll barrels are provided with devices applying substantially horizontal direction external forces in the same direction as the horizontal direction external forces applied to the axial ends of the work roll barrels.

(8) A rolling mill for flat products as set forth in any one of (1) to (7) characterized in that between the work roll chocks and rolling mill housing project blocks or work roll chock support members connected to backup roll chocks, work roll horizontal direction load detection devices for measuring the horizontal direction loads applied to the work rolls are provided.

(9) A rolling mill for flat products as set forth in any one of (1) to (8) characterized in that the devices applying substantially horizontal direction external forces to the work rolls have parts contacting the work rolls of roller types.

(10) A rolling mill for flat products as set forth in any one of (1) to (8) characterized in that the devices applying substantially horizontal direction external forces to the work rolls are hydrostatic bearing types able to transmit force to the work rolls through fluid pressure.

(11) A rolling method for flat products using a rolling mill for flat products having a pair of upper and lower work rolls driven by electric motors, a pair of upper and lower backup rolls contacting the work rolls and supporting rolling reaction force applied to the work rolls, and devices applying substantially horizontal direction external forces to barrels or shafts of the work rolls at positions of at least one location each at the work side and drive side across a center of the rolling mill in the width direction, for a total of two or more locations, for the respective upper and lower work rolls, the direction of external forces applied to the work rolls being the same direction as the horizontal direction force component of the rolling reaction force applied to the work rolls due to rolling direction offset between the work roll axial center positions and backup roll axial center positions, and the horizontal direction external forces applied to the work rolls being supported through work side and drive side work roll chocks and work roll horizontal direction load detection devices measuring the horizontal direction load by rolling mill housing project blocks or work roll chock support members connected to the backup roll chocks, and having load detection devices for measuring the rolling load at the work side and drive side of the rolling mill, the rolling method for flat products characterized by, in roll position zero point adjustment work before starting the rolling work, operating roll gap control devices of the rolling mill for flat products in a roll rotating state to set a kiss roll state, setting a total value of a work side load measurement value and drive side load measurement value by the rolling load measurement use load detection devices to a predetermined zero point adjustment load, adjusting the horizontal direction external forces applied from the work side and drive side horizontal direction external force application devices to the work rolls so that the outputs of the work roll horizontal direction load detection devices become values predetermined for the work side and drive side, adjusting the balance of the work side and drive side at the roll position to determine the roll position zero point so that the work side load measurement value and drive side load measurement value by the rolling load measurement use load detection devices become equal while maintaining this state, and performing rolling work based on this roll position zero point.

(12) A rolling method for flat products using a rolling mill for flat products having a pair of upper and lower work rolls driven by electric motors, a pair of upper and lower backup rolls contacting the work rolls and supporting rolling reaction force applied to the work rolls, and devices applying substantially horizontal direction external forces to barrels or shafts of the work rolls at positions of at least one location each at the work side and drive side across a center of the rolling mill in the width direction, for a total of two or more locations, for the respective upper and lower work rolls, the direction of external forces applied to the work rolls being the same direction as the horizontal direction force component of the rolling reaction force applied to the work rolls due to rolling direction offset between the work roll axial center positions and backup roll axial center positions, and the horizontal direction external forces applied to the work rolls being supported through work side and drive side work roll chocks and work roll horizontal direction load detection devices measuring the horizontal direction load by rolling mill housing project blocks or work roll chock support members connected to the backup roll chocks, the rolling method for flat products characterized by adjusting the horizontal direction external forces applied from the work side and drive side horizontal direction external force application devices to the work rolls so that the outputs of the work roll horizontal direction load detection devices become values predetermined for the work side and drive side and controlling the horizontal direction external forces so as to maintain this state while rolling.

<Explanation of Mode of Operation>

According to the invention of (1), by providing devices for applying substantially horizontal direction external forces in the same direction as the horizontal direction force component of the rolling reaction force applied to the work rolls due to rolling direction offset at both the upper and lower work rolls, it is possible to push the work rolls against high rigidity support members to stabilize the axial center positions, so it is possible to strictly eliminate the difference in offset of the work rolls at the upper and lower and left and right (work side WS/drive side DS) of the rolling mill occurring during rolling or in the kiss roll state of zero point adjustment work before rolling and possible to eliminate the problems of warping of the flat products and meander and camber due to the thrust force occurring between the work rolls and backup rolls.

According to the invention of (2), by providing devices for applying substantially horizontal direction external forces in the same direction as the horizontal direction force component of the rolling reaction force applied to the backup rolls due to the rolling direction offset at both the upper and lower backup rolls, it is possible to push the backup rolls against high rigidity support members to stabilize the axial center positions, so it is possible to eliminate the problems of warping of the flat products and meander and camber due to the thrust force occurring between the work rolls and backup rolls.

According to the invention of (3), by providing devices for applying substantially horizontal direction external forces to the work rolls at positions applying force near the ends of the work roll barrels, it is easy to apply the external forces and possible to prevent the horizontal direction deflection of the work rolls due to external forces from becoming excessive.

According to the invention of (4), by providing devices for applying substantially horizontal direction external forces to the work rolls at positions applying force to the axial ends of the work rolls outside the work roll chocks, it is possible to avoid interference with the guides of the rolled material and possible to reduce the horizontal direction clearance of the bearings.

According to the invention of (5), by providing devices for applying substantially horizontal direction external forces to the work rolls at positions applying force near the ends of the work roll barrels and at positions applying force to the axial ends of the work rolls outside the work roll chocks, it is possible to cancel out the horizontal direction deflection of the work rolls due to external forces of different directions.

According to the invention of (6), by providing devices for applying substantially horizontal direction external forces to the work rolls at positions applying force near the ends of the work roll barrels and providing the center parts of the work roll barrels with devices for applying substantially horizontal direction external forces smaller than and in an opposite direction from the total value of the horizontal direction external forces applied near the ends of the work roll barrels, it is possible to cancel out the horizontal direction deflection of the work rolls due to external forces of different directions.

According to the invention of (7), by providing devices for applying substantially horizontal direction external forces to the work rolls at positions applying force to the axial ends of the work rolls outside the work roll chocks and providing the center parts of the work roll barrels with devices for applying substantially horizontal direction external forces in the same direction as the horizontal direction external forces applied to the axial ends of the work rolls, it is possible to cancel out the horizontal direction deflection of the work rolls due to external forces of the same direction.

According to the invention of (8), by providing work roll horizontal direction load detection devices for measuring the horizontal direction loads applied to the work rolls between the work roll chocks and rolling mill housing project blocks or work roll chock support members connected to the backup roll chocks, it is possible to hold the left and right horizontal direction external forces equal, so it becomes possible to maintain the work rolls parallel to the backup rolls at all times and possible to prevent meander or camber of the flat products due to the occurrence of a thrust force.

According to the invention of (9), by making the parts of the devices for applying substantially horizontal direction external forces to the work rolls which contact the work rolls the roller type, it is possible to apply external force without scratching the work rolls and, further, it is possible to apply substantially horizontal direction external forces in a state with the work rolls moved up and down at the time of rolling.

According to the invention of (10), by making the devices for applying substantially horizontal direction external forces to the work rolls hydrostatic bearing types able to transmit force to the work rolls through fluid pressure, it is possible to apply external force to the work rolls in a noncontact state, so there is no concern over scratching the work rolls and the external force application device side is not worn much at all either.

According to the invention of (11), by adjusting the horizontal direction external forces applied from the work side and drive side horizontal direction external force application devices to the work rolls so that the outputs of the work roll horizontal direction load detection devices become values predetermined for the work side and drive side, adjusting the balance of the work side and drive side of the roll position to determine the roll position zero point so that the work side load measurement value and drive side load measurement value of the rolling load measurement use load detection devices become equal while maintaining this state, and performing the rolling work based on this roll position zero point, it is possible to hold the left and right horizontal direction external forces equal and constantly reproduce the accurate roll position zero point of a state with the thrust force between rolls made extremely small, so it is possible to prevent meander or camber of the flat product.

According to the invention of (12), by adjusting the horizontal direction external forces applied from the work side and drive side horizontal direction external force application devices to the work rolls so that the outputs of the work roll horizontal direction load detection devices become values predetermined for the work side and drive side and controlling the horizontal direction external forces so as to maintain this state while rolling, it is possible to hold the left and right horizontal direction external forces equal, so it is possible to prevent meander or camber of the flat product due to occurrence of thrust force during rolling.

The effects obtained by the present invention will be explained next. According to the present invention, it is possible to provide a rolling mill for flat products and a rolling method for flat products which can strictly eliminate the difference in offset of the work rolls at the upper and lower and left and right (work side WS/drive side DS) of rolling mill occurring in the kiss roll state of the zero point adjustment work etc. before rolling or during rolling and can eliminate the problem of warping of the flat products or meander or camber etc. due to the thrust force occurring between the work rolls and backup rolls and exhibit other remarkable effects in industry.

BRIEF DESCRIPTION OF THE DRAWINGS

FIG. 1(*b*) is a side view illustrating a first embodiment in a rolling mill for flat products of the present invention (case of 4Hi mill).

FIG. 1(*c*) is a side view illustrating a first embodiment in a rolling mill for flat products of the present invention (case of 6Hi mill).

FIG. 2(*b*) is a side view illustrating a first embodiment in a rolling mill for flat products of the present invention (backup roll chock hold-in type).

FIG. 3(*b*) is a side view illustrating a second embodiment in a rolling mill for flat products of the present invention (case of 6Hi mill).

EXPLANATION OF NOTATIONS

Figure 1:
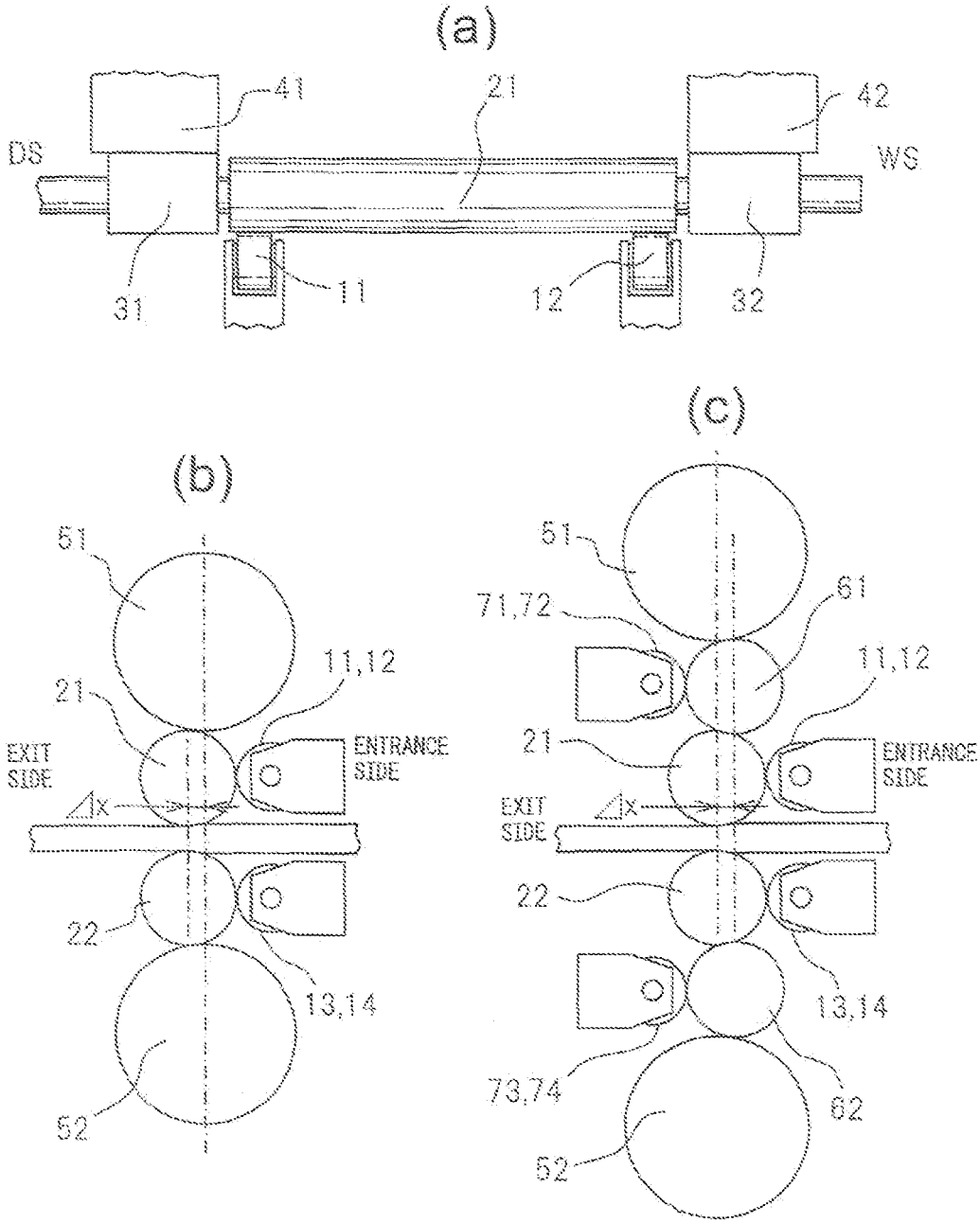
FIG. 1(*a*) is a plan view illustrating a first embodiment in a rolling mill for flat products of the present invention.

11, 12, 13, and 14 work roll press roller
21 and 22 work roll
31, 32, 33, and 34 work roll chock
41 and 42 project block (rolling mill housing)
51 and 52 backup roll
61 and 62 intermediate roll
71, 72, 73, and 74 intermediate roll press roller
81, 82, 83, and 84 work roll chock support member connected to backup roll chocks
91, 92, 93, and 94 backup roll press roller
101 and 102 work roll horizontal direction load detection device
111 and 112 press roller load detection device
121, 122, 123, and 124 work roll pushing use hydrostatic bearing
131 and 132 rolling load measurement use load detection device

MODE FOR CARRYING OUT THE INVENTION

The modes for carrying out the present invention will be explained in detail based on FIG. 1 to FIG. 10.

In FIG. 1 to FIGS. 10, 11, 12, 13, and 14 are work roll press rollers (11 and 12 are upper work roll press rollers and 13 and 14 are lower work roll press rollers. Below, in the same way, the side above the pass line of the rolled material is called "upper" and the side below it is called "lower"), 21 and 22 are work rolls, 31, 32, 33, and 34 are work roll chocks, 41 and 42 are project blocks (rolling mill housing), 51 and 52 are backup rolls, 61 and 62 are intermediate rolls, 71, 72, 73, and 74 are intermediate roll press rollers, 81, 82, 83, and 84 are work roll support members connected to the backup roll chocks, 91, 92, 93, and 94 are backup roll press rollers, 101 and 102 are work roll horizontal direction load detection devices, 111 and 112 are press roller load detection devices, 121, 122, 123, and 124 are work roll pushing use hydrostatic bearings, and 131 and 132 are rolling load measurement use load detection devices. The same elements are assigned the same reference numerals and overlapping explanations are omitted.

FIG. 1 is a view illustrating a first embodiment in the rolling mill for flat products of the present invention.

The rolling mill for flat products of the present invention has work rolls 21 and 22 driven by electric motors (not shown), backup rolls 51 and 52 contacting the work rolls 21 and 22 and supporting the rolling reaction force applied to the work rolls 21 and 22, and devices for applying substantially horizontal direction external forces (work roll press rollers 11, 12, 13, and 14) at positions of at least one location each at the work side and drive side across a center of the rolling mill in the width direction, for a total of two or more locations, for the work rolls 21 and 22. The direction of the horizontal direction external forces applied to the work rolls 21 and 22 is the same direction as the horizontal direction force component of the rolling reaction force applied to the work rolls 21 and 22 due to the rolling direction offset between the work roll axial center position and backup roll axial center position (Δx shown in FIGS. 1(*b*) and (*c*)).

Figure 2:
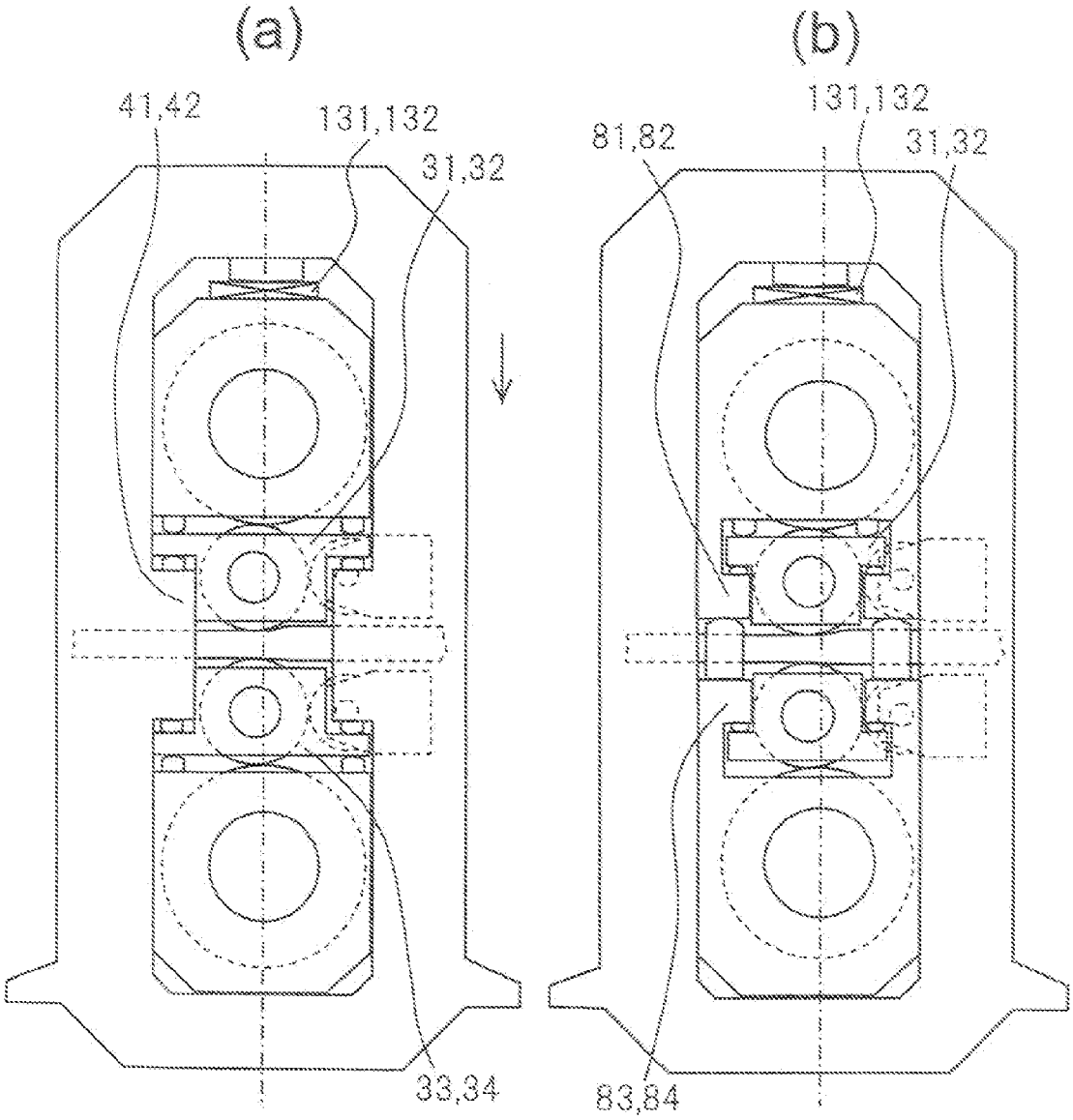
FIG. 2(*a*) is a side view illustrating a first embodiment in a rolling mill for flat products of the present invention (project block type).

Further, rolling mills for flat products include project block type rolling mills shown in FIG. 2(*a*) and backup roll chock hold-in type rolling mills shown in FIG. 2(*b*). In the case of a project block type rolling mill, the horizontal direction external forces applied to the work rolls 21 and 22 are supported through the work roll chocks 31, 32, 33, and 34 by the rolling mill housing project blocks 41 and 42, while in the case of an backup roll chock hold-in type rolling mill, they are supported by the work roll chock support members 81, 82, 83, and 84 connected to the backup roll chocks.

As the devices for applying substantially horizontal direction external forces in the same direction as the horizontal direction force component of the rolling reaction force applied to the work rolls 21 and 22 due to the rolling direction offset (Δx), for example, the work roll press rollers 11, 12, 13, and 14 such as shown in FIG. 1(*a*) are provided. These work roll press rollers 11, 12, 13, and 14 push the work rolls 21 and 22. By pushing the work rolls, in the case where the rolling mill is a project block type (FIG. 2(*a*)), the looseness between the shafts of the work rolls and bearings, the looseness of the bearings themselves, the looseness between the bearings and the bearing housings (roll chocks), and the looseness between the roll chocks and project blocks are absorbed and the high rigidity rolling mill housing project block surfaces can be made the reference surface. When the rolling mill is an backup roll chock hold-in type (FIG. 2(*b*)), the looseness between the shafts of the work rolls and bearings, the looseness of the bearings themselves, the looseness between the bearings and the bearing housings (roll chocks), the looseness between the roll chock's and the work roll chock support members, and the looseness between the work roll chock support members and the rolling mill housing window surface are absorbed and the high rigidity rolling mill housing window surface can be made the reference surface.

In this way, it is possible to push against the high rigidity rolling mill housing member to stabilize the axial center positions, so it is possible to strictly eliminate the difference in offset of the work rolls at the upper and lower and left and right (work side WS/drive side DS) of the rolling mill occurring during rolling or in the kiss roll state of the zero point adjustment work before rolling and possible to eliminate the problems of warping of the flat products and meander and camber due to the thrust force occurring between the work rolls and backup rolls.

The devices for applying substantially horizontal direction external forces to the work rolls 21 and 22 are, as shown in FIG. 1(*a*), preferably provided at positions applying force near ends of the work roll barrels. For example, by providing the work roll press rollers 11, 12, 13, and 14 such as shown in FIG. 1(*a*) at positions applying force near the ends of the work roll barrels, external forces can be easily applied and it is possible to prevent horizontal direction deflection of the work rolls due to external forces.

Further, by making the parts of the devices for applying substantially horizontal direction external forces to the work rolls 21 and 22 contacting the work rolls 21 and 22 shown in FIG. 1(*a*) the roller type, it is possible to apply external force without scratching the work rolls. Further, it is possible to apply the substantially horizontal direction external forces in the tilted state even if the work rolls move up and down during rolling.

When using the rolling mill for flat products of the present invention for rolling, first, in the roll position zero point adjustment work before starting the rolling work, the roll gap control devices of the rolling mill for flat products are operated in the roll rotating state to set the kiss roll state and set a predetermined zero point adjustment load, then the balance of the work side and drive side at the roll position is adjusted to determine the roll position zero point and the rolling work is performed while applying left and right horizontal direction external forces preset based on this roll position zero point.

Note that, the present invention can be applied to not only a four-stage rolling mill having work rolls 21 and 22 and backup rolls 51 and 52 (4Hi mill) such as shown in FIG. 1(*b*) but also a five-stage rolling mill or a six-stage rolling mill (6Hi mill) having work rolls 21 and 22, intermediate rolls 61 and 62, and backup rolls 51 and 52 such as shown in FIG. 1(*c*). In the case of a five-stage rolling mill or six-stage rolling mill having intermediate rolls 61 and 62, the "backup rolls" in the present invention also mean the intermediate rolls 61 and 62 directly supporting the work rolls 21 and 22.

Further, the expression "external force" applied to the work rolls in the present invention is used in the sense of 1) acting independently from the rolling load and 2) attachment of a device for applying force to the housing or another structure outside the work rolls.

Figure 3:
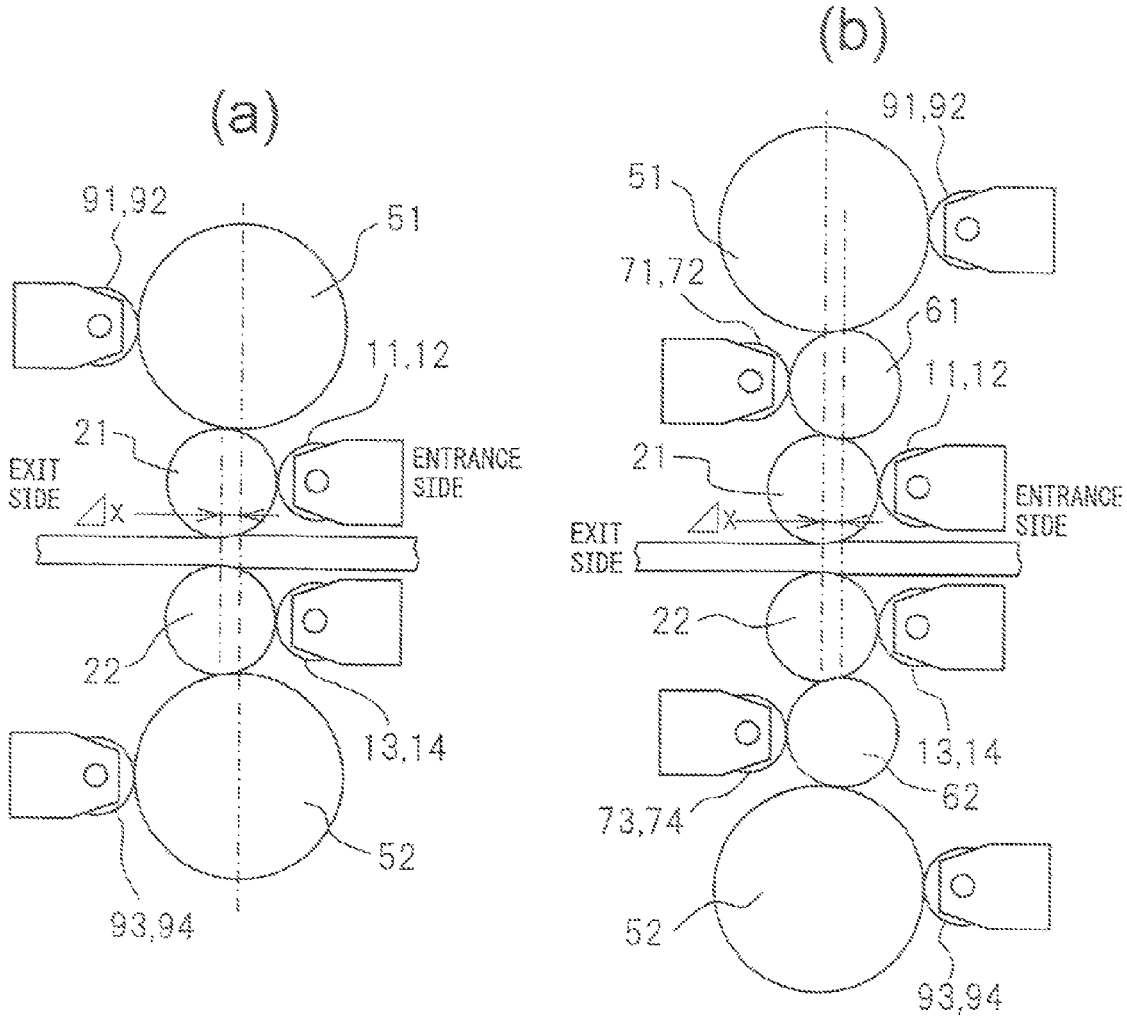
FIG. 3(*a*) is a side view illustrating a second embodiment in a rolling mill for flat products of the present invention (case of 4Hi mill).

FIG. 3 is a view illustrating a second embodiment in the rolling mill for flat products of the present invention.

The second embodiment in the rolling mill for flat products of the present invention is characterized in that the mill has, in addition to the above-mentioned devices for applying substantially horizontal direction external forces to the work rolls, devices for applying substantially horizontal direction external forces (backup roll press rollers 91, 92, 93, and 94) at positions of at least one location each at the work side and drive side across a center of the rolling mill in the width direction, for a total of two or more locations, for the backup rolls 51 and 52 and in that the direction of the horizontal direction external forces applied to the backup rolls 51 and 52 is the same direction as the horizontal direction force component of the rolling reaction force applied to the backup rolls by the rolling direction offset of the work roll axial center positions and backup roll axial center positions.

In the case of the 4Hi mill shown in FIG. 3(*a*) and the 6Hi mill shown in (b), for example, the backup roll press rollers 91, 92, 93, and 94 shown in FIGS. 3(*a*), (*b*) are provided. By using these backup roll press rollers to apply substantially horizontal direction external forces in the same direction as the horizontal direction force component of the rolling reaction force applied to the backup rolls due to the rolling direction offset, it is possible to push the backup rolls 51 and 52 against the high rigidity rolling mill housing members to stabilize the axial center positions, so it is possible to further reduce the warping of the flat products and the meander and camber due to the thrust force occurring between the work rolls and backup rolls.

Figure 4:
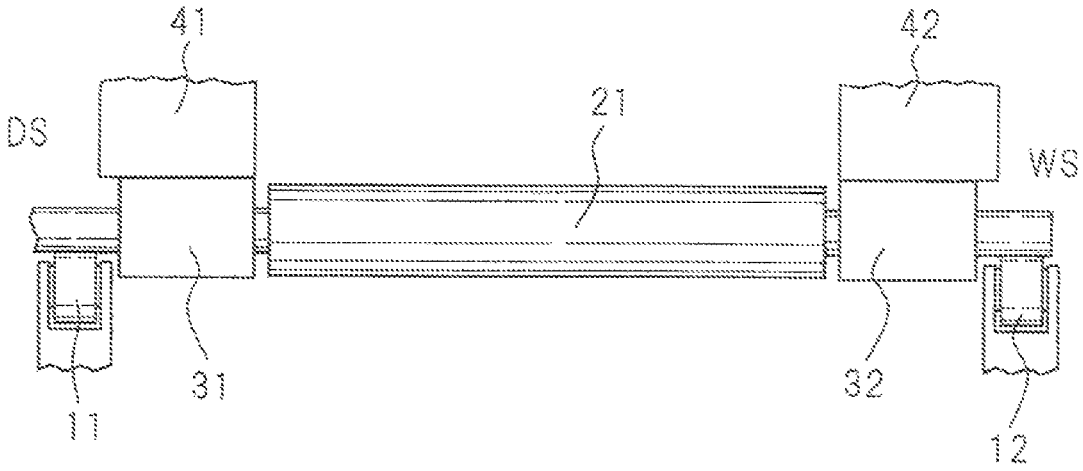
FIG. 4 is a plan view illustrating a third embodiment in a rolling mill for flat products of the present invention.

FIG. 4 is a view illustrating a third embodiment in the rolling mill for flat products of the present invention.

The third embodiment in the rolling mill for flat products of the present invention is characterized in that devices for applying substantially horizontal direction external forces to the work rolls 21 and 22 (work roll press rollers 11 and 12) are provided at positions applying force to the axial ends of the work rolls outside the work roll chocks 31 and 32.

By providing the work rolls 21 and 22 with work roll press rollers 11 and 12 such as shown in FIG. 4 at positions applying force to the axial ends of the work rolls outside the work roll chocks 31 and 32, it is possible to avoid interference with the guides of the rolled material and also to reduce the horizontal direction clearance at the bearings.

Note that it is also possible to attach the devices for applying substantially horizontal direction external forces to the work rolls 21 and 22 (work roll press rollers 11 and 12) to the work roll chocks 31 and 32. In this case, the forces becomes internal forces of the work rolls 21 and 22 including the chocks, so to stabilize the positions of the work roll chocks 31 and 32, devices for pushing the work roll chocks 31 and 32 in the horizontal direction become essential.

Figure 5:
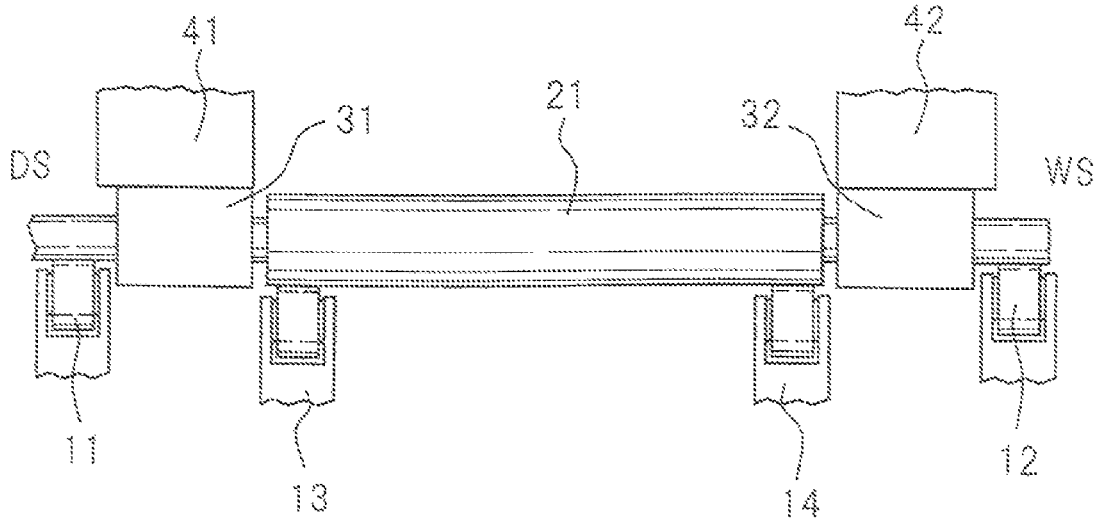
FIG. 5 is a plan view illustrating a fourth embodiment in a rolling mill for flat products of the present invention.

FIG. 5 is a view illustrating a fourth embodiment in the rolling mill for flat products of the present invention.

The fourth embodiment in the rolling mill for flat products of the present invention is characterized in that devices for applying substantially horizontal direction external forces to the work rolls 21 and 22 (work roll press rollers 11, 12, 13, and 14) are provided at positions applying force near the ends of the barrels of the work rolls 21 and 22 and at positions applying force to the axial ends of the work rolls outside the work roll chocks 31 and 32.

By providing the work rolls 21 and 22 with the work roll press rollers 11, 12, 13, and 14 such as shown in FIG. 5 at positions applying force near the ends of the barrels of the work rolls 21 and 22 and positions applying force to the axial ends of the work rolls outside the work roll chocks 31 and 32, it is possible to cancel out the horizontal direction deflection of the work rolls due to external force.

Figure 6:
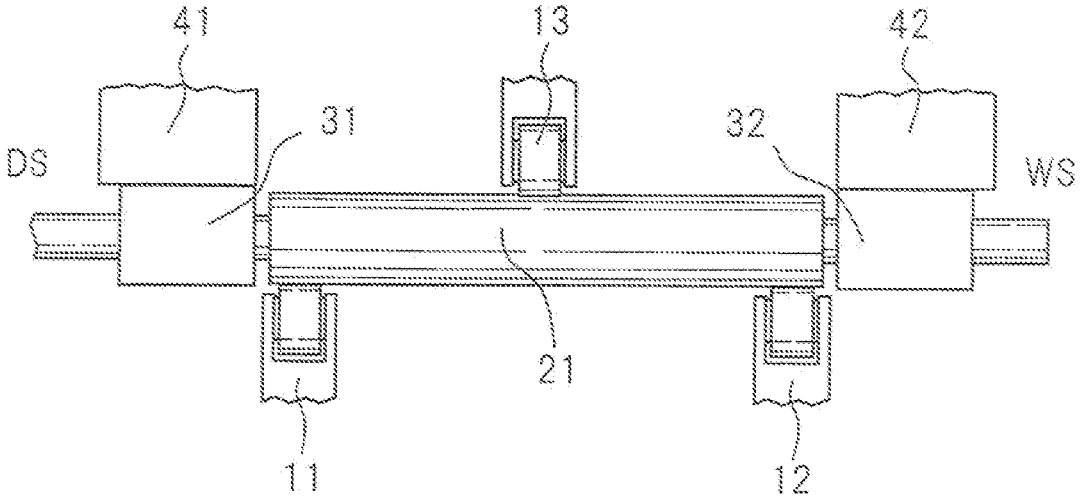
FIG. 6 is a plan view illustrating a fifth embodiment in a rolling mill for flat products of the present invention.

FIG. 6 is a view illustrating a fifth embodiment in the rolling mill for flat products of the present invention.

The fifth embodiment in the rolling mill for flat products of the present invention is characterized in that devices for applying substantially horizontal direction external forces to the work rolls 21 and 22 (work roll press rollers 11 and 12) are provided positions applying force near the ends of the barrels of the work rolls 21 and 22 and the center parts of the barrels of the work rolls 21 and 22 are provided with devices for applying substantially horizontal direction external forces (work roll press rollers 13) smaller than and in an opposite direction to the total value of the horizontal direction external forces applied near the ends of the work roll barrels.

By providing the work rolls 21 and 22 with work roll press rollers 11 and 12 such as shown in FIG. 6 at positions applying force near the ends of the barrels of the work rolls 21 and 22 and providing the center parts of the barrels of the work rolls 21 and 22 with work roll press rollers 13 applying force smaller than and in an opposite direction to the total value of the horizontal direction external forces applied near the ends of the work roll barrels, it is possible to cancel out the horizontal direction deflection of the work rolls due to the external forces of the different directions.

Figure 7:
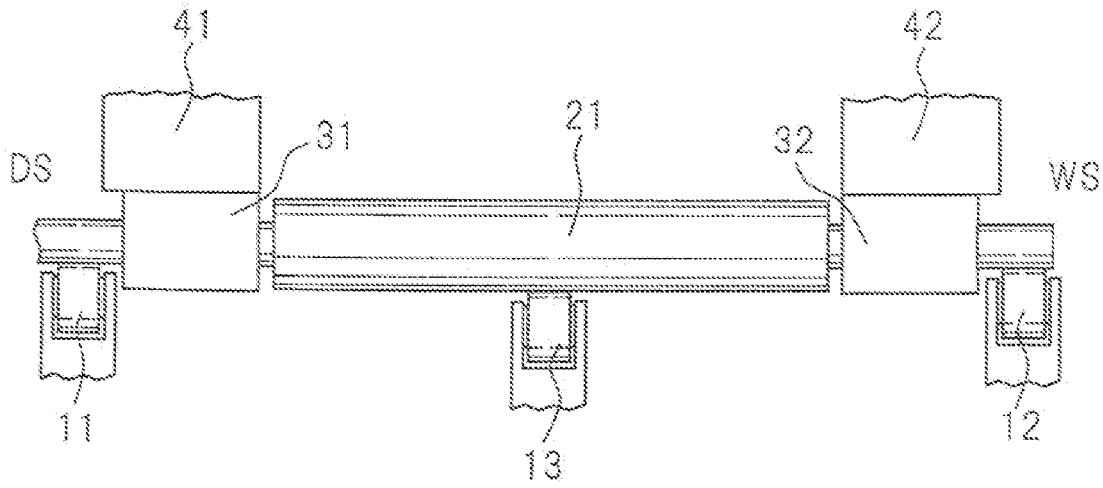
FIG. 7 is a plan view illustrating a sixth embodiment in a rolling mill for flat products of the present invention.

FIG. 7 is a view illustrating a sixth embodiment in the rolling mill for flat products of the present invention.

The sixth embodiment in the rolling mill for flat products of the present invention is characterized in that devices for applying substantially horizontal direction external forces to the work rolls 21 and 22 (work roll press rollers 11 and 12) are provided at positions applying force to the axial ends of the work rolls outside the work roll chocks 31 and 32 and in that the center parts of the work roll barrels are provided with devices for applying substantially horizontal direction external forces in the same direction as the horizontal direction external forces applied to the work roll axial ends (work roll press rollers 13).

By providing the work rolls 21 and 22 with the work roll press rollers 11 and 12 such as shown in FIG. 7 at positions applying force to the axial ends of the work rolls outside the work roll chocks 31 and 32 and providing the center parts of the work roll barrels with the work roll press rollers 13, it is possible to cancel out the horizontal direction deflection of the work rolls due to external forces of the same direction.

Figure 8:
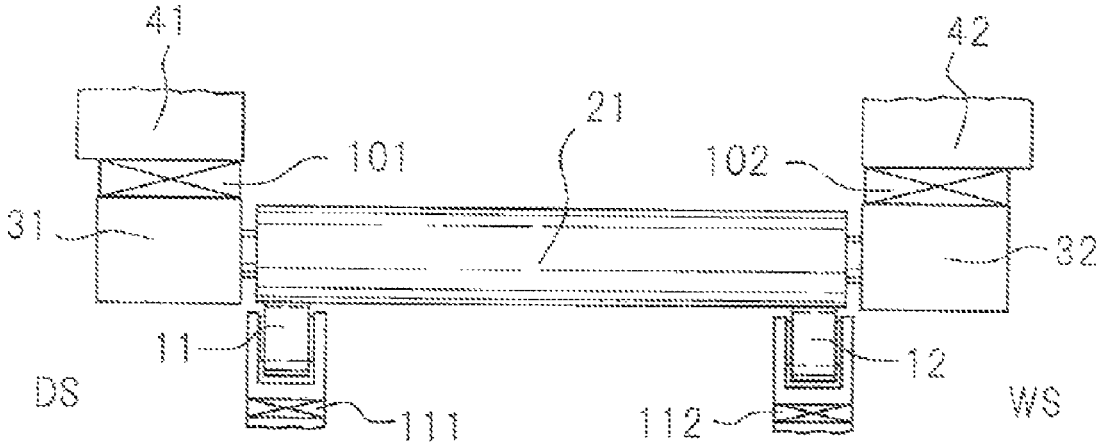
FIG. 8 is a plan view illustrating a seventh embodiment in a rolling mill for flat products of the present invention.

FIG. 8 is a view illustrating a seventh embodiment in the rolling mill for flat products of the present invention.

The seventh embodiment in the rolling mill for flat products of the present invention is characterized by the provision of work roll horizontal direction load detection devices 101 and 102 measuring the horizontal direction loads applied to the work rolls 21 and 22 between the work roll chocks 31 and 32 and rolling mill housing project blocks 41 and 42. The rolling mill housing project blocks 41 and 42 may be the work roll chock support members 81, 82, 83, and 84 connected to the backup roll chocks.

By providing work roll horizontal direction load detection devices 101 and 102 measuring the horizontal direction loads applied to the work rolls 21 and 22 between the work roll chocks 31 and 32 and rolling mill housing project blocks 41 and 42 or work roll chock support members 81, 82, 83, and 84 connected to the backup roll chocks, it is possible to hold the left and right horizontal direction external forces equal, so it is possible to prevent meander or camber of the flat products due to the occurrence of thrust force. At this time, similar effects are obtained even if the rolling mill housing project blocks 41 and 42 are work roll chock support members 81, 82, 83, and 84 connected to the backup roll chocks.

Note that the layout of the load detection devices 111 and 112 of the press rollers is a preferable embodiment and may be switched by the pressures of the hydraulic cylinders giving the pushing forces. However, the horizontal direction forces measured by the work roll horizontal direction load detection devices 101 and 102 are the composite forces of the horizontal direction forces acting from the press rollers and measured by the press roller load detection devices 111 and 112 and the forces acting from the backup rolls to the work rolls including the offset forces, so the functions of the work roll horizontal direction load detection devices 101 and 102 can be replaced by the press roller load detection devices 111 and 112.

It goes without saying, but work roll horizontal direction load detection devices and press roller load detection devices are preferably set for the upper and lower work rolls.

Figure 9:
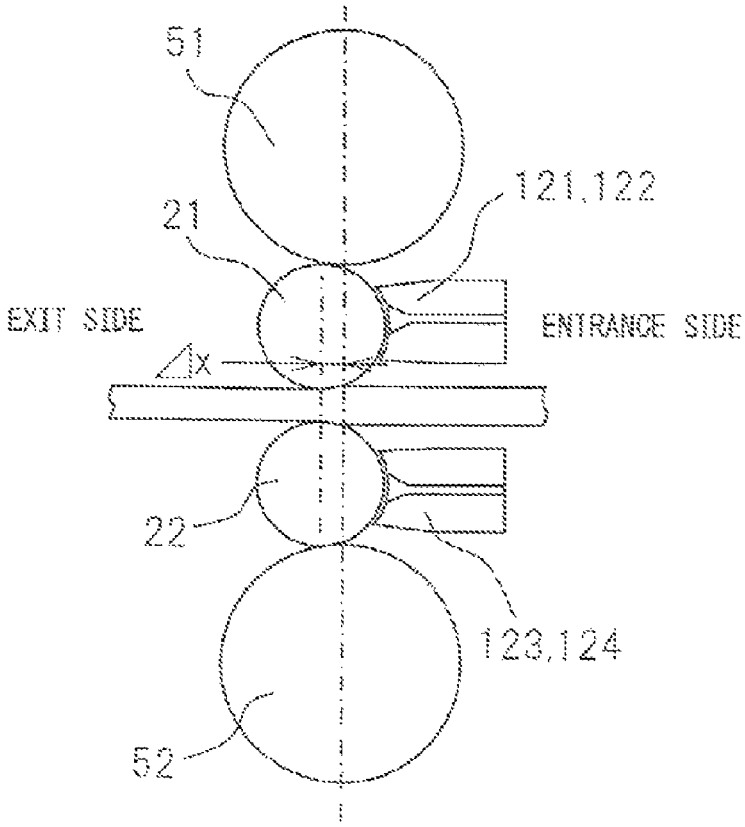
FIG. 9 is a side view illustrating an eighth embodiment in a rolling mill for flat products of the present invention (case of 4Hi mill).

FIG. 9 is a view illustrating an eighth embodiment in the rolling mill for flat products of the present invention.

The eighth embodiment in the rolling mill for flat products of the present invention is characterized in that the devices for applying substantially horizontal direction external forces to the work rolls 21 and 22 (work roll pushing use hydrostatic bearings 121, 122, 123, and 124) are hydrostatic bearing types able to transmit force to the work rolls through fluid pressure.

By making the devices for applying substantially horizontal direction external forces to the work rolls 21 and 22 hydrostatic bearing types able to transmit force to the work rolls through oil, water, or other fluid pressure, it is possible to apply external force to the work rolls in a noncontact state, so there is no worry about scratching the work rolls and the external force application devices are also no longer worn much at all.

Figure 10:
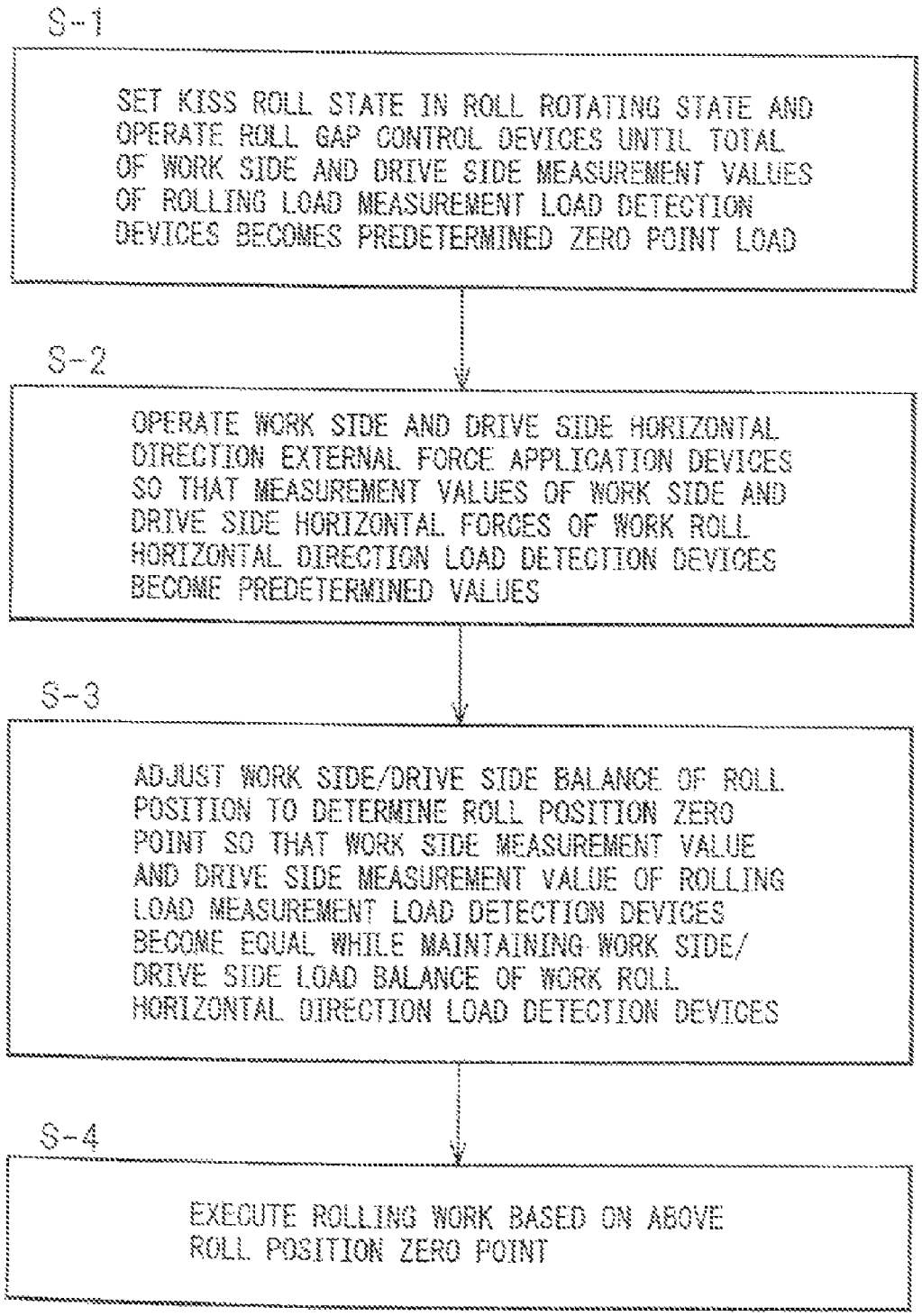
FIG. 10 is a flow chart illustrating an embodiment in the rolling method for flat products of the present invention.

FIG. 10 is a flow chart illustrating an embodiment of the rolling method for flat products of the present invention.

The embodiments of the rolling mills for flat products used in the rolling method for flat products of the present invention are as explained above, so the explanations are omitted.

First, in the roll position zero point adjustment work before starting the rolling work, the roll gap control devices of the rolling mill for flat products are operated in the roll rotating state to set the kiss roll state and the total value of the work side load measurement value and drive side load measurement value of the rolling load measurement use load detection devices 131 and 132 is set to a predetermined zero point adjustment load (FIG. 10, S-1).

Next, the horizontal direction external forces applied from the work side and drive side horizontal direction external force application devices to the work rolls are adjusted so that the outputs of the work roll horizontal direction load detection devices 101 and 102 become values/predetermined for the work side and drive side (FIG. 10, S-2).

Next, the balance of the work side and drive side at the roll position is adjusted to determine the roll position zero point so that the work side load measurement value and drive side load measurement value of the rolling load measurement use load detection devices 131 and 132 become equal while maintaining the work side WS/drive side DS load balance of the work roll horizontal direction load detection devices 101 and 102 (FIG. 10, S-3).

Further, rolling work is performed based on this roll position zero point (FIG. 10, S-4).

By adjusting the horizontal direction external forces applied from the work side and drive side horizontal direction external force application devices to the work rolls so that the outputs of the work roll horizontal direction load detection devices 101 and 102 become values predetermined for the work side and drive side, adjusting the balance of the work side and drive side of the roll position to determine the roll position zero point so that the work side load measurement value and drive side load measurement value of the rolling load measurement use load detection devices 131 and 132 become equal while maintaining this state, and performing the rolling work based on this roll position zero point, it is possible to hold the left and right horizontal direction external forces equal and constantly reproduce the accurate roll position zero point in the state with the thrust force between rolls minimized, so it is possible to prevent meander or camber of the flat products.

Note that, in the present invention, the kiss roll state at the time of roll position zero point adjustment is also predicated on the rolls being in a rotating state.

Further, usually, the roll gap control zero point adjustment is performed when changing work rolls, so the work rolls can be considered to have the symmetric left and right profiles of right after grinding, but the adjustment is not necessarily performed for the backup rolls right after changing them, so consideration must be given to the fact that they are generally asymmetric left and right due to uneven wear during use etc.

When setting the kiss roll state in this state, the left and right unbalance in the diameters of the backup rolls cause the offset force components acting from the backup rolls to the work rolls to become asymmetric left and right. Through the work roll necks and bearing clearances, this results in the axes of the work rolls being inclined slightly in the horizontal plane. As a result, thrust force is generated between the work rolls and backup rolls. This disturbs the left-right balance of the rolling load detection use load detection devices 131 and 132. If performing the zero point adjustment at the roll position in this state, accurate adjustment is no longer possible. This becomes a cause of meander and camber.

As opposed to this, as described in (11), if adjusting the horizontal direction external forces applied to the work rolls so that the outputs of the work roll horizontal direction load measurement use load detection devices 101 and 102 become the same at the work side WS and drive side DS, the horizontal forces applied to the work roll necks and work roll bearings become equal at the drive side and the work side, so it is possible to maintain the axes of the work rolls in a posture the same as the state with no uneven wear of the backup rolls.

Therefore, no thrust force occurs between the rolls and accurate roll position zero point adjustment becomes possible.

Further, as described in (12), by adjusting the horizontal direction external forces applied from the work side and drive side horizontal direction external force application devices to the work rolls so that the outputs of the work roll horizontal direction load detection devices 101 and 102 become values predetermined for the work side WS and drive side DS and controlling the horizontal direction external forces so as to maintain this state while rolling, it is possible to hold the left and right horizontal direction external forces equal, so it is possible to prevent meander or camber of the flat product due to occurrence of thrust force during rolling.

Above, the explanation was given with reference to the configuration shown in FIG. 8, but, as explained above, the work roll horizontal direction load detection devices are preferably set so as to correspond to the upper and lower work rolls. Therefore, in the above explanation as well, it goes without saying that the zero point adjustment work and rolling control are performed based on the output values of the work roll horizontal direction load detection devices set at the upper and lower.

Further, when providing the backup rolls or intermediate rolls with horizontal direction force imparting devices as well in the same way as the work rolls, it is also possible to set the horizontal direction load detection devices at the backup rolls or intermediate rolls. By performing the zero point adjustment of the rolling position including the output detected by these detection devices and adjusting the horizontal direction external forces applied from the work side and drive side horizontal direction external force application devices to the work rolls, intermediate rolls, backup rolls so that the outputs of these horizontal direction load detection device become values predetermined for the work side WS and drive side DS and rolling while controlling the horizontal direction external forces so as to maintain this state, it is possible to hold the left and right horizontal direction external forces equal, so it is possible to prevent meander or camber of the flat product occurring due to the thrust force during rolling more accurately.

INDUSTRIAL APPLICABILITY

According to the present invention, it is possible to provide a rolling mill for flat products and rolling method for flat products which can strictly eliminate the difference in offset of work rolls at the upper and lower and left and right (work side WS/drive side DS) of the rolling mill occurring during rolling or in the kiss roll state of the zero point adjustment work before rolling and eliminate the problem of warping of the flat products or meander or camber due to the thrust force acting between the work rolls and backup rolls. Remarkable effects in industry are exhibited.

The invention claimed is:

1. A rolling mill for flat products, the rolling mill comprising:

an upper work roll and a lower work roll, the upper work roll and the lower work roll driven by electric motors, and each having an axial center;

an upper backup roll and a lower backup roll, the upper backup roll contacting said upper work roll, and said lower backup roll contacting said lower work roll, said upper and lower backup rolls supporting a rolling reaction force applied to said upper and lower work rolls, the axial centers of said work rolls offset in a horizontal direction from the axial centers of said backup rolls; and devices configured to apply external forces in a substantially horizontal direction to barrels or shafts of said upper and lower work rolls, at least one device positioned at each of a work side and a drive side of the upper and lower work rolls; wherein the external forces are applied to said work rolls in the same direction as the horizontal component of the rolling reaction force applied to said work rolls due to the rolling direction offset between said work roll axial center positions and backup roll axial center positions, and the external forces applied to said work rolls are supported through work roll chocks by project blocks of the rolling mill housing or work roll chock support members connected to backup roll chocks.

2. The rolling mill for flat products as set forth in claim 1, further comprising:

devices applying substantially horizontal direction external forces to barrels or shafts of said backup rolls at positions of at least one location each at the work side and drive side across a center of the rolling mill in the width direction, for a total of two or more locations, for the respective upper and lower backup rolls; and the direction of horizontal direction external forces applied to said backup rolls is the same direction as the horizontal direction force component of the rolling reaction force applied to said backup rolls due to rolling direction offset between said work roll axial center positions and backup roll axial center positions.

3. The rolling mill for flat products as set forth in claim 1, wherein said devices applying substantially horizontal direction external forces to the work rolls are provided at positions applying force near ends of said work roll barrels.

4. The rolling mill for flat products as set forth in claim 1, wherein said devices apply substantially horizontal external forces to the work rolls at positions applying force to axial ends of the work rolls outside said work roll chocks.

5. The rolling mill for flat products as set forth in claim 1, wherein said devices apply substantially horizontal direction external forces to the work rolls at positions applying force near ends of said work roll barrels and at positions applying force to axial ends of the work rolls outside said work roll chocks.

6. The rolling mill for flat products as set forth in claim 1, wherein said devices apply substantially horizontal direction external forces to the work rolls at positions applying force near ends of said work roll barrels; and center parts of said work roll barrels are provided with devices applying substantially horizontal direction external forces smaller than and in an opposite direction from the total value of said horizontal direction external force applied near the axial ends of said work roll barrels.

7. The rolling mill for flat products as set forth in claim 1, wherein said devices apply substantially horizontal direction external forces to the work rolls at positions applying force to axial ends of the work rolls outside said work roll chocks; and center parts of said work roll barrels are provided with devices applying substantially horizontal direction external forces in the same direction as said horizontal direction external force applied to the axial ends of said work roll barrels.

8. The rolling mill for flat products as set forth in claim 1, further comprising: work roll horizontal direction load detection devices for measuring the horizontal direction loads applied to said work rolls positioned between said work roll chocks and rolling mill housing project blocks or work roll chock support members connected to backup roll chocks.

9. The rolling mill for flat products as set forth in claim 1, wherein said devices applying substantially horizontal direction external forces to the work rolls have parts contacting said work rolls of roller types.

10. The rolling mill for flat products as set forth in claim 1, wherein said devices applying substantially horizontal direction external forces to the work rolls are hydrostatic bearing types able to transmit force to said work rolls through fluid pressure.

11. A method for rolling flat products using a rolling mill for flat products, wherein the rolling mill comprises:

an upper work roll and a lower work roll, the upper work roll and the lower work roll driven by electric motors, and each having an axial center;

an upper backup roll and a lower backup roll, the upper backup roll contacting said upper work roll, and said lower backup roll contacting said lower work roll, said upper and lower backup rolls supporting a rolling reaction force applied to said work rolls, and devices configured to apply external forces in a substantially horizontal direction to barrels or shafts of said upper and lower work rolls, at least one device positioned at each of a work side and a drive side of the upper and lower work rolls; wherein the external forces are applied to said work rolls in the same direction as the horizontal component of the rolling reaction force applied to said work rolls due to the rolling direction offset between said work roll axial center positions and backup roll axial center positions, the external forces applied to said work rolls are supported through work side and drive side work roll chocks, and work roll horizontal direction load detection devices are positioned to measure the horizontal direction load by rolling mill housing project blocks or work roll chock support members connected to the backup roll chocks, and load detection devices are positioned to measure the rolling load at the work side and drive side of the rolling mill, said method for rolling flat products comprising:

in roll position zero point adjustment work before starting the rolling work, operating a roll gap control devices of said rolling mill for flat products in a roll rotating state to set a kiss roll state, setting a total value of a work side load measurement value and drive side load measurement value by said rolling load measurement use load detection devices to a predetermined zero point adjustment load, adjusting the horizontal direction external force applied from said work side and drive side horizontal direction external force application devices to the work rolls so that the outputs of said work roll horizontal direction load detection devices become values predetermined for the work side and drive side, adjusting the balance of the work side and drive side at the roll position to determine the roll position zero point so that the work side load measurement value and drive side load measurement value by said rolling load measurement use load detection devices become equal while maintaining this state, and performing rolling work based on this roll position zero point.

12. A method for rolling flat products using a rolling mill for flat products, said rolling mill comprising:

an upper work roll and a lower work roll, the upper work roll and the lower work roll driven by electric motors, and each having an axial center;

an upper backup roll and a lower backup roll, the upper backup roll contacting said upper work roll, and said lower backup roll contacting said lower work roll, said upper and lower backup rolls supporting a rolling reaction force applied to said work rolls, and devices configured to apply external forces in a substantially horizontal direction to barrels or shafts of said upper and lower work rolls, at least one device positioned at each of a work side and a drive side of the upper and lower work rolls; wherein the external forces are applied to said work rolls in the same direction as the horizontal component of the rolling reaction force applied to said work rolls due to the rolling direction offset between said work roll axial center positions and backup roll axial center positions, and the external forces applied to said work rolls are supported through work side and drive side work roll chocks, and work roll horizontal direction load detection devices are positioned to measure the horizontal direction load by rolling mill housing project blocks or work roll chock support members connected to the backup roll chocks, said method for rolling flat products comprising:

adjusting the horizontal direction external forces applied from said work side and drive side horizontal direction external force application devices to the work rolls so that the outputs of said work roll horizontal direction load detection device become values predetermined for the work side and drive side and controlling said horizontal direction external force so as to maintain this state while rolling.

13. The rolling mill for flat products as set forth in claim 2, wherein said devices applying substantially horizontal direction external forces to the work rolls are provided at positions applying force near ends of said work roll barrels.

14. The rolling mill for flat products as set forth in claim 2, wherein said devices apply substantially horizontal external forces to the work rolls at positions applying force to axial ends of the work rolls outside said work roll chocks.

15. The rolling mill for flat products as set forth in claim 2, wherein said devices apply substantially horizontal direction external forces to the work rolls at positions applying force near ends of said work roll barrels and at positions applying force to axial ends of the work rolls outside said work roll chocks.

16. The rolling mill for flat products as set forth in claim 2, wherein said devices apply substantially horizontal direction external forces to the work rolls at positions applying force near ends of said work roll barrels; and center parts of said work roll barrels are provided with devices applying substantially horizontal direction external forces smaller than and in an opposite direction from the total value of said horizontal direction external force applied near the axial ends of said work roll barrels.

17. The rolling mill for flat products as set forth in claim 2, wherein said devices apply substantially horizontal direction external forces to the work rolls at positions applying force to axial ends of the work rolls outside said work roll chocks; and center parts of said work roll barrels are provided with devices applying substantially horizontal direction external forces in the same direction as said horizontal direction external force applied to the axial ends of said work roll barrels.

18. The rolling mill for flat products as set forth in claim 2, further comprising: work roll horizontal direction load detection devices for measuring the horizontal direction loads applied to said work rolls positioned between said work roll chocks and rolling mill housing project blocks or work roll chock support members connected to backup roll chocks.

19. The rolling mill for flat products as set forth in claim 2, wherein said devices applying substantially horizontal direction external forces to the work rolls have parts contacting said work rolls of roller types.

20. The rolling mill for flat products as set forth in claim 2, wherein said devices applying substantially horizontal direction external forces to the work rolls are hydrostatic bearing types able to transmit force to said work rolls through fluid pressure.

* * * * *